US012758836B2

(12) United States Patent
Marcos Andrada et al.

(10) Patent No.: US 12,758,836 B2
(45) Date of Patent: Oct. 13, 2026

(54) SPORTS RACQUET AND MANUFACTURING METHOD

(71) Applicant: SPORTS RTD HUB, S.L., Madrid (ES)

(72) Inventors: Samuel Marcos Andrada, Madrid (ES); Iñaki Ferreras Martín, Madrid (ES); Alejandro González Hernández, Madrid (ES); Gonzalo Linares Martínez, Madrid (ES)

(73) Assignee: SPORTS RTD HUB. S.L., Madrid (ES)

( * ) Notice: Subject to any disclaimer, the term of this patent is extended or adjusted under 35 U.S.C. 154(b) by 131 days.

(21) Appl. No.: 18/880,278

(22) PCT Filed: Jun. 27, 2023

(86) PCT No.: PCT/EP2023/067447
§ 371 (c)(1),
(2) Date: Dec. 31, 2024

(87) PCT Pub. No.: WO2024/003036
PCT Pub. Date: Jan. 4, 2024

(65) Prior Publication Data

US 2025/0387683 A1 Dec. 25, 2025

(30) Foreign Application Priority Data

Jul. 1, 2022 (EP) ..... 22382625

(51) Int. Cl.
*A63B 59/48* (2015.01)
*A63B 102/08* (2015.01)

(52) U.S. Cl.
CPC ..... *A63B 59/48* (2015.10); *A63B 2102/08* (2015.10)

(58) Field of Classification Search
CPC ..... A63B 59/48; A63B 2102/08
(Continued)

(56) References Cited

U.S. PATENT DOCUMENTS 5,054,780 A * 10/1991 Chen ..... A63B 60/02 473/519
8,192,308 B2 * 6/2012 DeMasi ..... A63B 60/00 473/532

(Continued)

FOREIGN PATENT DOCUMENTS

CA 3038087 A1 9/2020
CN 108619686 B 7/2021

(Continued)

*Primary Examiner* — Nini F Legesse
(74) *Attorney, Agent, or Firm* — Bayramoglu Law Offices LLC

(57) ABSTRACT

A sports racquet includes a frame provided with a head portion and a handle portion, a central body couplable to a cavity provided in the head portion, and at least one impact plate couplable to an attachment region arranged in the head portion and/or couplable to the central body, preferably two impact plates couplable facing each other with respect to the head portion, wherein in the attachment region there are attachment means configured for coupling the impact plate. The method for manufacturing the central body and the impact plates, as well as the assembly of the racquet in the different modalities thereof are provided.

20 Claims, 12 Drawing Sheets

(58) Field of Classification Search
USPC ..... 473/519, 521, 527, 532–534
See application file for complete search history.

(56) References Cited

U.S. PATENT DOCUMENTS

| | | | | |
|---|---|---|---|---|
| 2015/0360081 | A1 | 12/2015 | Zhao et al. | |
| 2022/0296973 | A1* | 9/2022 | Bonfigli ..... | A63B 60/50 |
| 2023/0149785 | A1* | 5/2023 | Lin ..... | A63B 60/52<br>473/527 |

FOREIGN PATENT DOCUMENTS

| | | | |
|---|---|---|---|
| CN | 216653316 | U | 6/2022 |
| ES | 1056714 | U | 5/2004 |
| ES | 1180810 | U | 4/2017 |

* cited by examiner

FIG. 3A
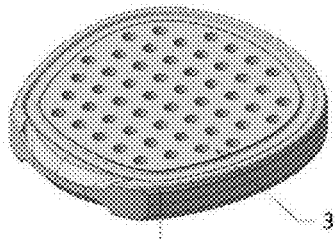
FIG. 3B
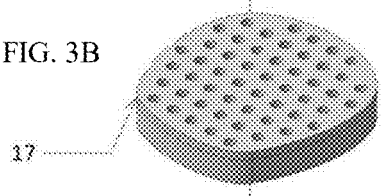
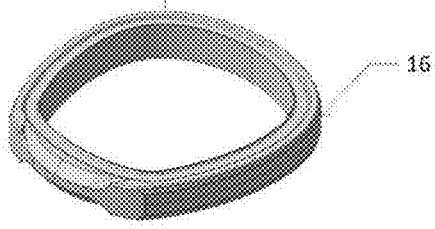
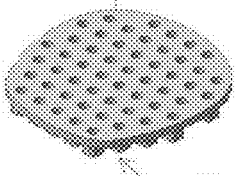
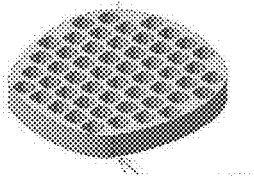
FIG. 3C
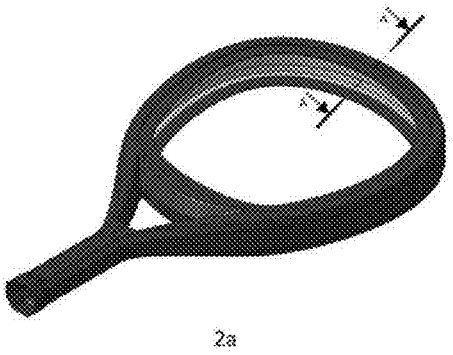
FIG. 4A
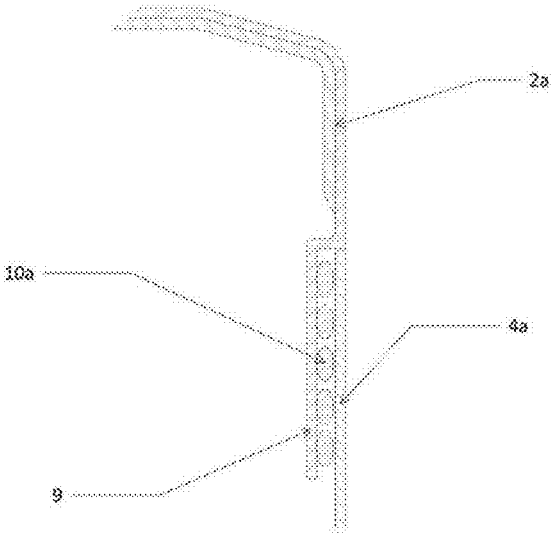
FIG. 4B

SPORTS RACQUET AND MANUFACTURING METHOD

CROSS-REFERENCE TO THE RELATED APPLICATIONS

This application is the national phase entry of International Application No. PCT/EP2023/067447, filed on Jun. 27, 2023, which is based upon and claims priority to European Patent Application No. 22382625.6, filed on Jul. 1, 2022, the entire contents of which are incorporated herein by reference.

TECHNICAL FIELD

This invention relates to the technical field of sports racquet, and in particular to a sports racquet and the method for manufacturing some of the components thereof, which incorporates notable innovations and advantages over the techniques used up to now.

More specifically, the invention proposes the development of a modular-type sports racquet wherein the elements that make it up can be assembled such that the racquet can be suited to the preferences of the player and said player's style of play, optimizing the performance thereof. The manufacturing method by means of which some of the components of this sports racquet are obtained is also disclosed.

BACKGROUND

Different racquets for sports practices, such as paddle tennis or ping-pong, are known in the state of the art. Generally, paddle sports racquets are manufactured in a "single-piece" with associated shape and features that are fixed and immovable throughout the useful life thereof. In this sense, if the racquet breaks or if the player wishes to change certain properties related to the performance of the racquet itself, greater control or speed, said player will inevitably have to completely replace said racquet with a new one.

In this sense, some solutions have been provided in the art in an attempt to obtain a sports racquet for sports such as paddle tennis or the like in which some elements can be exchanged during the useful life thereof, to provide it with flexibility and enable the replacement of elements and the customization of the same.

A reflection of the above is Spanish utility model ES1180810U which discloses a detachable and transformable paddle racquet including an impact core surrounded by a perimeter rim defined in a racquet structure the lower portion thereof extends into two ends to which a handle is coupled, wherein said impact core and said racquet are capable of being assembled and disassembled from each other, wherein the racquet structure has, at least at some point of said rim, an opening that defines two independent sides capable of being separated determining an expansion of the rim such that it allows the impact core to be placed or extracted from the inside of the frame in which it is embedded, subsequently recovering the initial position thereof.

The main drawback of the invention disclosed in the reference utility model is that the rim must be opened or closed at the ends to be able to couple the impact core, which will cause fatigue in the material portion of the frame that acts as an opening/closing pivot point of the same, being able to cause a failure of the same. In addition, the maximum elongation of the reinforcing fibers is only 2-4%, so the flexibility required of the structure to sufficiently open the racquet and insert a volume as large as the impact core entails a technical risk that is very difficult to solve if the solution is based on the elongation of the material; since above that very optimistic 4% and the usual 2%, the fibers would break. Another drawback is that the impact core is a single piece in which both the core, an area that absorbs the impact of the ball, and the impact plates, where the ball impacts, are arranged, so that some affectation of the core or the impact plates require the complete replacement of the impact core. Therefore, although this utility model already includes a level of modularity of a racquet or paddle, it has limitations or drawbacks that can be improved.

Another disclosure is the Spanish utility model ES1056714U, which provides a paddle tennis racket that can be repaired, having the paddle tennis racket a frame, two perforated soft cores and two optional perforated hitting plates. The frame has a circular body, a neck, a handle and a support element. The neck has an open end and a closed end. The circular body is attached to the open end, and the handle is attached to the closed end of the neck. The perforated soft cores are mounted within the circular body, and the support member is mounted between the perforated soft cores to support the perforated soft cores. The perforated striking plates are respectively mounted on the perforated soft cores. When a perforated striking plate or perforated soft core breaks, the perforated striking plate or perforated soft core can be replaced with a new one, so that the paddle tennis racket does not have to be discarded.

Although the above-mentioned paddle tennis racket is directed to a paddle provided with interchangeable parts, wherein the support element (supporting net) is limiting the configuration of the inner soft core, making mandatory to provide two perforated soft cores, instead of, for example, one single soft core. Further, the means for the attachment of the inner soft cores and/or the perforated hitting plates to the frame does not allows different alternatives for the attachment of those parts as always must be linked to the support element.

On the other hand, the utility model CN216653316U discloses a racket, which includes a frame body and a handle, the frame body includes a frame wall and a grab handle which are connected with each other, and the frame wall encloses an accommodating space; the three-dimensional net rack is arranged in the accommodating space, one circumferential side of the three-dimensional net rack is fixedly connected to the frame wall, and the three-dimensional net rack includes a plurality of channels penetrating through the two sides of the three-dimensional net rack in the thickness direction; the two face patting parts are arranged on the two opposite sides of the three-dimensional net rack and fixedly connected to the frame wall, each face patting part includes a plurality of through holes, and the through holes correspond to and are communicated with the channels.

In the racket disclosed above the way of fixing the three-dimensional net rack to the inner frame wall is by using an adhesive material, which is a disadvantage in terms of interchangeability. Also, in further embodiments, there is a partition part in the frame for supporting two support frames cores, which are also joined to the frame and the partition part by adhesive material, which does not allow different alternatives for the attachment of those parts and limiting the interchange of the plates or cores.

On the other hand, the traditional processes by means of which sports racquets are manufactured, particularly paddle racquets, all the elements that make up the racquet are molded in the same step, so that both the frame, the core and the impact plates are solidly joined, which makes it impossible to exchange any of said elements.

Based on the foregoing, sports racquets, especially paddle racquets, can have improvements regarding the level of modularization/customization thereof, which directly impacts the possibility of varying/improving the mechanical properties, such as stiffness, weight and sensations at game level. The manufacturing methods associated with this type of modular racquets can also be improved.

SUMMARY

In order to respond to the needs detected in the state of the art, the present invention provides a sports racquet as described in independent claim 1, wherein said sports racquet is designed to be modular or configurable such that the components of the same are adapted according to the choice of each user based on the level of play of the same or on the conditions of use that said player intends to give to said sports racquet.

Moreover, the invention claims a method of manufacturing and assembling the sports racquet as disclosed in claim 12, wherein this method discloses the novel and inventive techniques that enable the modularity features of the sports racquet of claim 1 and the dependent claims thereof to be obtained.

A sports racquet like that which the present invention encompasses, hereinafter racquet, includes a head portion coupled to a handle portion, wherein the head portion includes at least one structure configured to impact a game ball. In this sense, said structure is made up of an impact plate couplable to the head portion. Preferably two impact plates can be coupled opposite to and facing each other in the head portion, wherein the latter includes an attachment region for the coupling of the impact plate or plates.

In the head portion there is a cavity in which a central body can be coupled, wherein said central body has, among others, the function of absorbing the impact of the ball; wherein the impact plate (or the two impact plates) can also be coupled to said central body.

The frame is a hollow one-piece monocoque structure in which the head portion and the handle portion are permanently coupled. The head portion has an essentially ring, arch or arcuate shape, wherein said cavity is defined along said head portion. Preferably, this cavity has an essentially "C" transversal shape, wherein the attachment region is arranged at each of the open ends of said "C". Preferably the attachment region is in the form of a flange which extends at least over a section of the head portion, preferably along the entire length of the head portion. In this sense, the "C"-shaped cavity has two flanges arranged in respective open ends of said "C".

Now, in said attachment region, attachment means configured for coupling the impact plate are arranged.

It is important to note that the racquet is completely configurable, i.e., that both the frame, the central body and the impact plates can be individually chosen to obtain specific functionalities of said racquet, for example, weight, sensation of stiffness, touch with the ball, etc. In addition to the above, and given the configuration of the attachment means, the racquet can be permanent, semi-permanent, or releasable.

Thus, the attachment means includes an adhesive means at least partially arranged in the attachment region, the adhesive means being configured to permanently or semi-permanently join the impact plate(s) to the attachment region of the head portion. Alternatively, the attachment means include a releasable connection system configured to releasably join the impact plate to the head portion.

Within the context of the invention "joining/attachment/permanent coupling" relates to a type of connection between elements which, once achieved, does not allow the elements to be easily or trivially uncoupled, and even, when trying to uncouple them, it is not possible to guarantee the structural integrity of the elements.

Moreover, within the context of the invention, "semi-permanent joining/attachment/coupling" relates to the type of joining or coupling between two elements that allows their uncoupling by means of some technique (e.g., application of heat) guaranteeing the structural integrity of the elements.

Likewise, within the context of the invention, "releasable joining/attachment/coupling" relates to the type of connection or coupling between two elements that allows them to be easily uncoupled (e.g., coupling/uncoupling of threaded fasteners) without applying any technique, while guaranteeing the structural integrity of the elements.

Furthermore, the central body can be configured as a single piece couplable in the cavity of the head portion.

Alternatively, the central body is made up of a first portion with a ring-like arrangement enabled for insertion into the cavity of the head portion and a second portion couplable to the first portion.

In another alternative arrangement, the second portion of the central body is in turn formed by a first part and a second part couplable together. For this arrangement an impact plate will be coupled to the first part, and another impact plate will be coupled to the second part. In this way, as the first and second parts can be coupled together, and these in turn can be coupled to the first portion with a ring-like arrangement of the central body, the racquet is configured as a completely modular and detachable racquet.

Moreover, the racquet is provided with detection means arranged in the frame and/or in the central body, being configured to record data on the use of the racquet, and also configured to transmit said data to an external terminal.

Likewise, as previously mentioned, the invention also discloses a method for manufacturing and assembling a sports racquet with the features described so far, wherein this method includes the steps of:

- providing a racquet frame with the features described above;
- manufacturing the central body and providing the same;
- manufacturing the impact plate and providing the same; and
- assembling the central body and two impact plates on the frame.

In this sense, the frame provided is previously manufactured under methods of handling and shaping structures based on composite materials, for example, carbon fiber, glass, Kevlar, which enable a monocoque frame to be obtained in which the handle and the head portion may be coupled, or the frame is a single piece with handle and head portion that are permanently joined. Additionally, depending on the type of racquet, once the frame is provided, it is machined for final shaping.

Furthermore, within the context of the invention, machining relates to the shaping operation of a part or material that involves chip removal by means of a cutting tool to give the desired shape to the part or material.

With regard to the step of manufacturing the central body, this includes the steps of machining (e.g., on a CNC milling machine) a block of polymeric material.

As for the manufacture of the impact plate, this includes the steps of:

providing a composite material (carbon fibers, glass, Kevlar or any combination, or similar materials) in prepreg format, wherein this prepreg material (in sheet or fabric format) is cut according to patterns or shapes and orientations (e.g., 90° or 45°) obtaining patterned sheets;

depositing at least one layer of patterned sheet making an impact plate preform of a preset thickness in a mold;

performing a curing cycle, heating the mold with the impact plate preform to a preset curing temperature and applying a preset curing vacuum pressure, monitoring and controlling the start, hold and end of the curing temperature and curing vacuum pressure;

demolding the shaped impact plate from the mold; and machining the impact plate for final shaping.

Furthermore, the step of depositing the patterned sheet by making an impact plate preform of a preset thickness in a mold, further includes depositing layers of patterned fabric made of composite material to form a ring on the periphery of the impact plate preform, this ring being thicker than the predetermined thickness of the impact plate preform.

Additionally, in the step of manufacturing the impact plate, holes are made in said plate during machining, and a countersinking or counterboring is carried out in the outer ring.

Moreover, in the step of machining a block of polymeric material to form the central body, by means of machining, said central body is divided into three portions:

a ring intended to be inserted into the cavity of the frame;

a first part and a second part couplable together, which in turn can be coupled to the ring.

BRIEF DESCRIPTION OF THE DRAWINGS

The foregoing and other advantages and features will be more fully understood from the following detailed description of exemplary embodiments with reference to the accompanying drawings, which should be considered by way of illustration and not limitation, wherein:

FIGS. 3A-3C represent a series of perspective views of the central body in the different embodiments thereof.

FIGS. 4A-4B are a perspective view of the frame and a cross-sectional view wherein a modality of the attachment means in the form of a permanent joining is shown.

DETAILED DESCRIPTION OF THE EMBODIMENTS

In the following detailed description, numerous specific details are set forth in the form of examples to provide a thorough understanding of the relevant teachings. However, it will be apparent to those skilled in the art that the present teachings can be implemented without such details.

Figure 1:
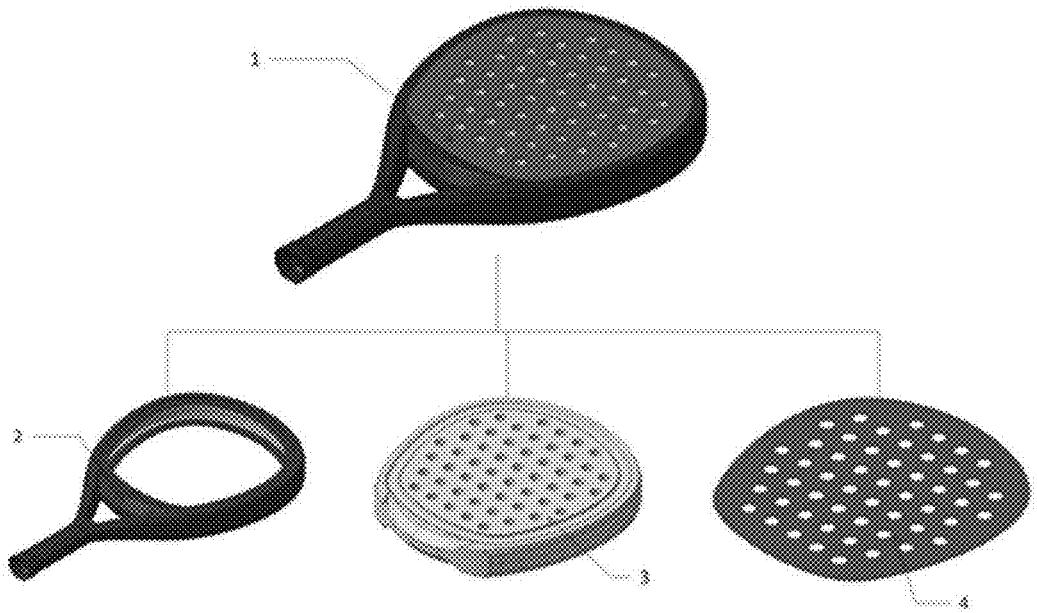
FIG. 1 is a perspective view of the sports racquet of the invention in an assembled and disassembled state.

As seen in FIG. 1, the present invention provides a sports racquet (1), hereinafter racquet (1), including a frame (2) having a head portion (2.2) and a handle portion (2.1), a central body (3) couplable to the head portion of the frame (2.2), and at least one impact plate (4) couplable to an attachment region (9) provided in the head portion of the frame (2.2) and/or couplable to the central body (3). Preferably, two impact plates (4) can be coupled opposite to and facing each other in respective attachment regions (9) of the head portion (2.2).

Figure 2A:
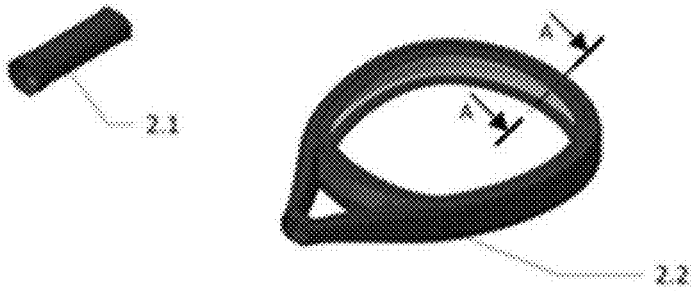
FIG. 2A is a perspective view of the frame in a disassembled state, wherein the head portion and the handle portion are seen separately.

Alternatively, as seen in FIG. 2A, the handle portion (2.1) can be coupled and uncoupled from the head portion (2.2), therefore resulting in a frame (2) that is also detachable between these two portions for all the following preferred embodiments and their alternatives. However, in the preferred embodiment, the frame (2) is a single piece (monocoque), so that the head portion (2.2) and the handle portion (2.1) are permanently joined.

As can be seen from the foregoing, the racquet (1) provided is designed to be assembled/detachable, the frame (2), the central body (3) and the impact plates (4) being able to be manufactured in independent processes, wherein depending on the manner in which these elements are joined, and as will be detailed later, the racquet (1) may belong to the permanent joining (5) (FIG. 11), semi-detachable joining (6) (FIG. 12), or completely detachable joining (7) (FIGS. 10 and 13) type.

Figure 2B:
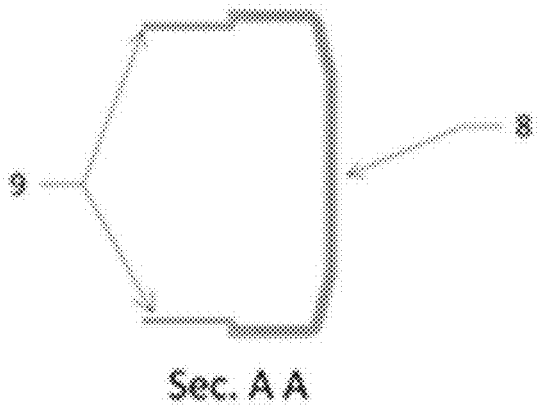
FIG. 2B is a schematic cross-sectional transverse view wherein the cavity of the head portion is observed.

As can be seen in FIG. 3A, in one embodiment the central body (3) is a single piece including a perimeter portion intended to be coupled to the head portion of the frame (2.2). To achieve this coupling, the head portion (2.2) has a cavity (8), preferably a "C" transversal shape, the sports racquet being seen in an AA profile cross-section, so that the perimeter portion of the central body (3) is configured to be inserted into this cavity of the head portion (2.2). In this sense, as seen in FIG. 2B, in order to attach the impact plates (4) to the head portion (2.2), the attachment region (9) takes the form of flanges (9) defined by the "C" transversal shaped cavity (8), such that the impact plate (4) is coupled to one of said flanges (9). The person skilled in the art will see that, in order to have the racquet (1), two impact plates (4) are arranged to be coupled in these flanges (9) of the head portion (2.2) facing each other on sides or faces opposite to the central body (3).

As seen in FIGS. 4A-4B, when the impact plates (4) are permanently joined to the frame (2) and/or to the central body (3), the latter being coupled by the perimeter portion in the cavity of the head, by means of an adhesive means applied to the flanges (9), such as epoxy structural adhesive (10*a*), or through a welding process, or some other analogous technique, the sports racquet with permanent joining (5) (FIG. 3A) is obtained. Although the sports racquet (1) is permanently assembled, it is possible to choose both the frame (2), the central body (3) (foam material, density, volume distribution, etc.) and the materials of the impact plates (4), such that the sports racquet (1) has unique features, although the elements are permanently joined.

Figure 7A:
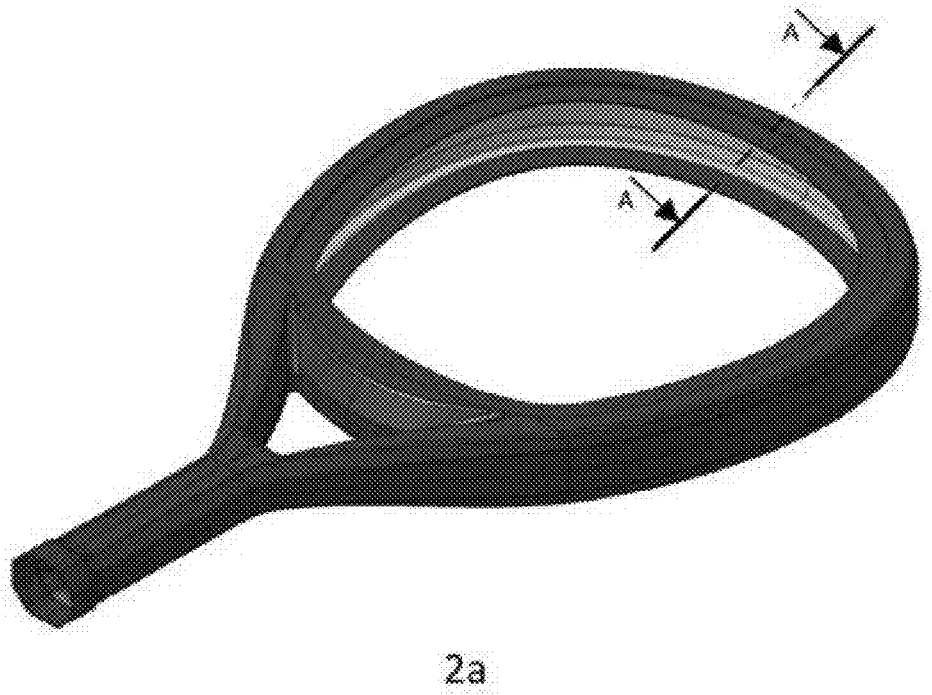
Figure 7B:
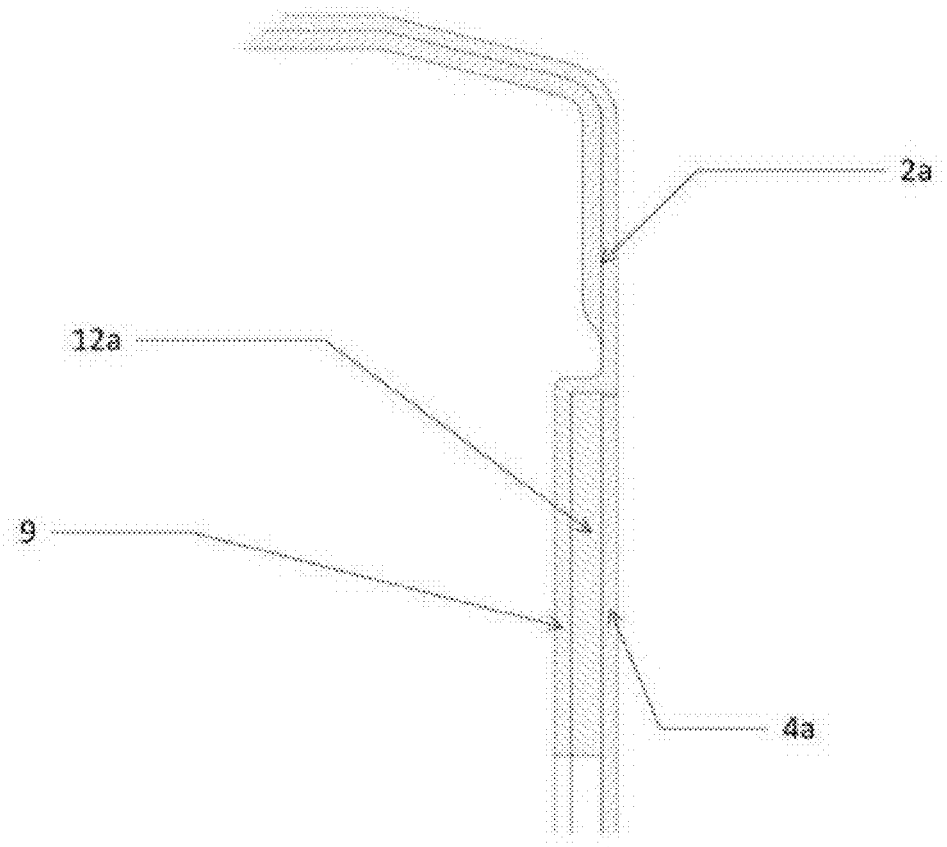

In another preferred embodiment, illustrated in FIGS. 7A-7B, when the impact plates (4) are semi-permanently joined to the frame (2) by means of a high-strength double-sided adhesive tape applied on the flanges (9), such as an acrylic foamed adhesive tape (12*a*) so that the impact plates (4) can be semi-permanently attached to the frame (2), and the impact plates (4) are further joined to the central body (3) by means of a double-sided adhesive tape, the latter being coupled by the perimeter portion in the cavity of the head (2.2), the sports racquet with semi-permanent joining (6) is obtained.

Figure 5A:
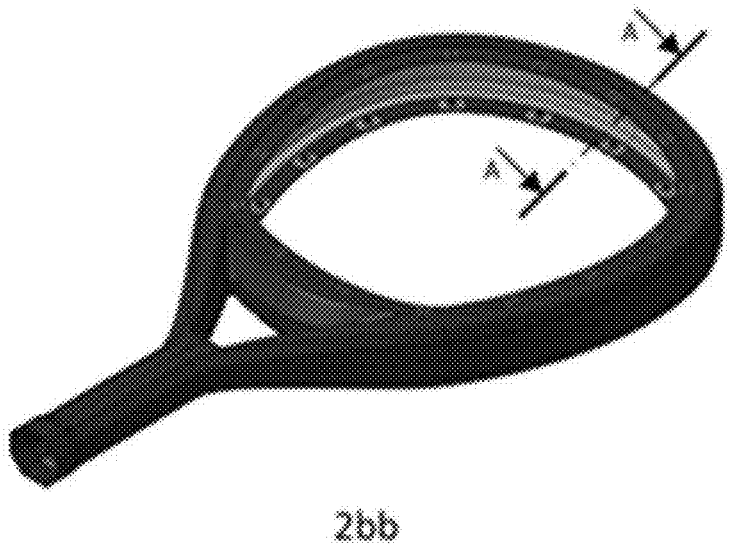
FIGS. 5A-5C are a perspective view of the frame and a cross-sectional view wherein a modality of the attachment means in the form of a detachable joining is shown.
Figure 6A:
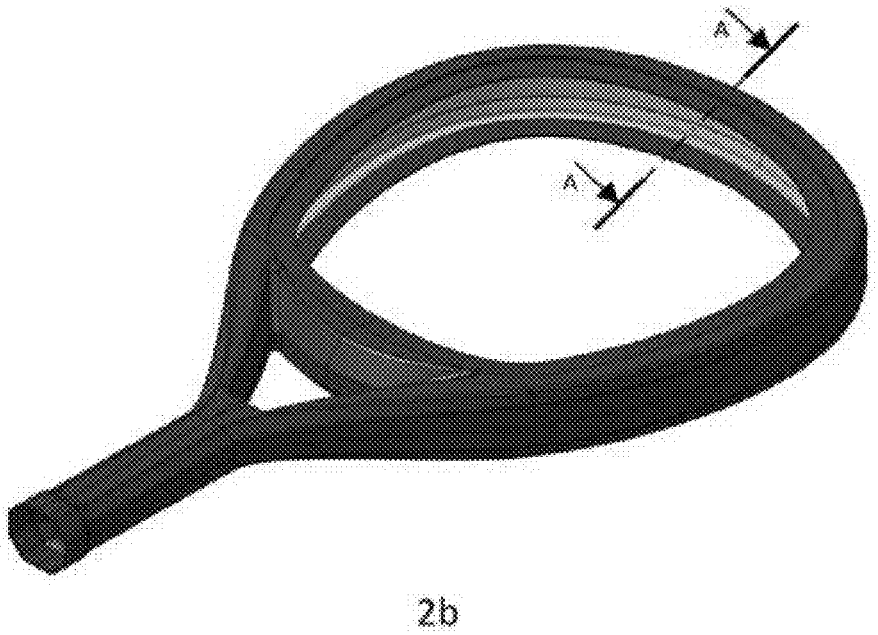
FIGS. 6A-6B and FIGS. 7A-7B are a perspective view of the frame and a cross-sectional view wherein a modality of the attachment means in the form of a semi-permanent joining is shown.
Figure 6B:
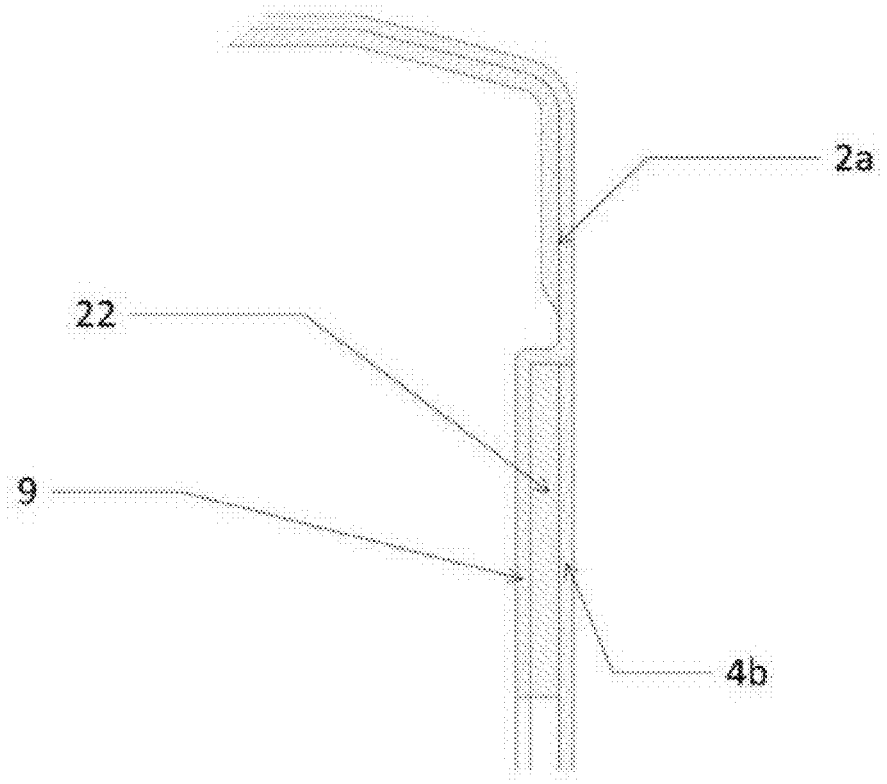

Alternatively, as seen in FIGS. 6A-6B, the impact plates (4) are semi-permanently joined to the frame (2) by a hook and loop fastener (22). In this way we have another sports racquet (7*b*) (FIG. 5A) with a completely detachable joining.

Figure 5B:
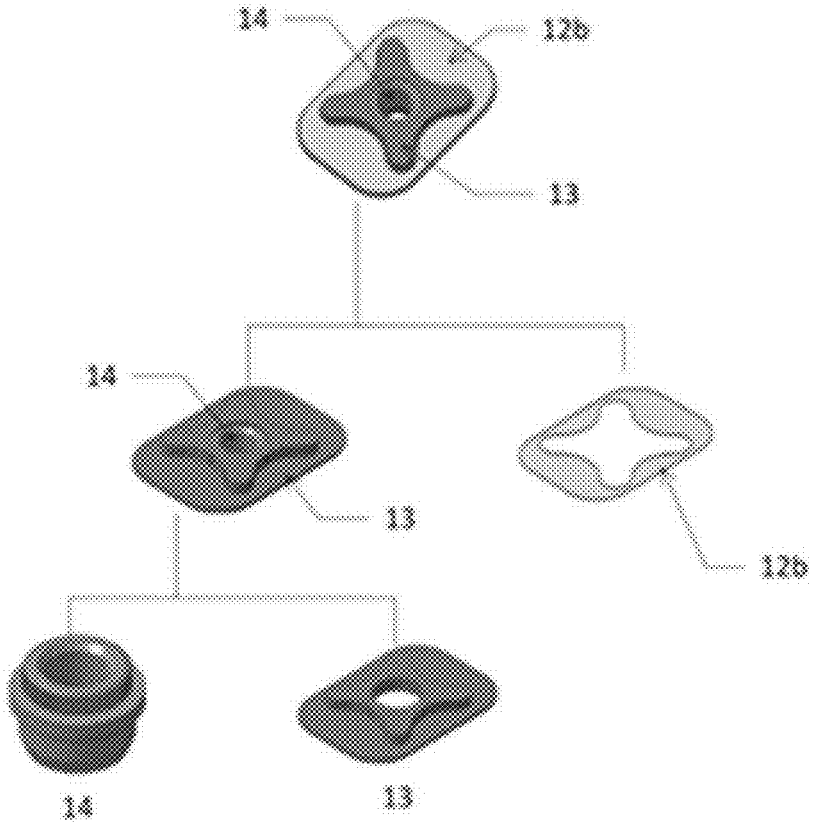
Figure 5C:
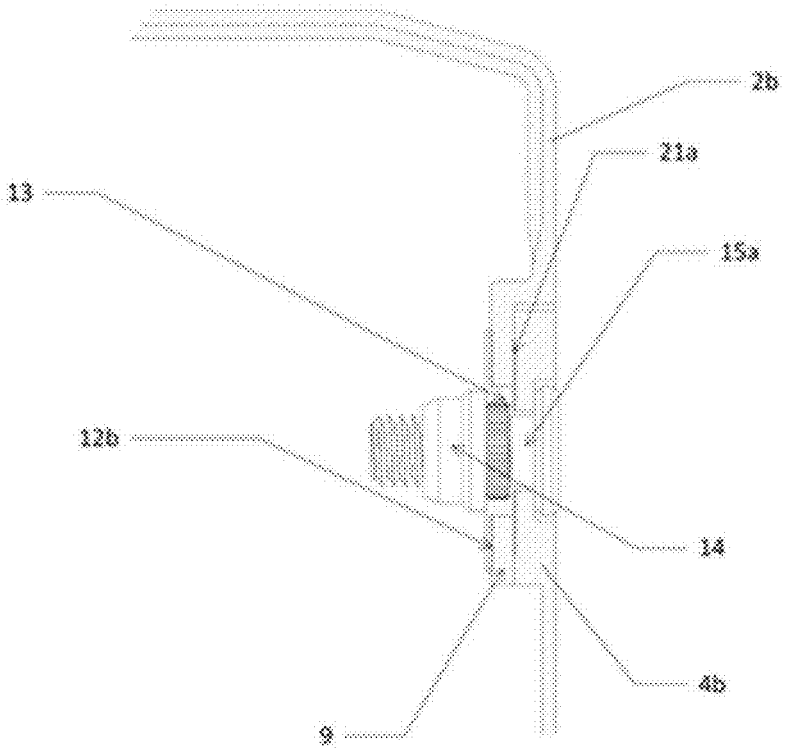

In another preferred embodiment, as shown in FIGS. 5A-5C, the flanges (9) of the frame (2) further incorporate holes suitable for coupling, using a type of high-strength double-sided adhesive such as an acrylic foamed adhesive tape (12*b*), star-shaped inserts (13) with a hole each, such as a 4-pointed star, on which other self-locking female threaded inserts (14) are assembled. The star shaped insert (13) is ideal for withstanding the tightening torque of a threaded fastener (15) on a self-locking female threaded insert (14) when the impact plate (4) is coupled without moving in relation to the flange (9). In this way the impact plates (4) can be detachably attached to the frame by means of a common threaded fastener such as a screw (15*a*). The racquet (7) (FIG. 4A) with a detachable attachment is thus obtained.

In this sense, the attachment regions (9) (flanges) include a plurality of insert assemblies (12*b*, 13, 14) spacedly fixed therein, each of said insert assemblies being configured for the coupling of a threaded fastener (15). Therefore, the impact plates (4) are configured to be coupled to the attachment region by the combination of assembly inserts (12*b*, 13, 14) and fasteners (15).

Alternatively, as a more simplified assembly, the flanges (9) of the frame (2) are further machined with holes suitable for the coupling of self-locking female threaded inserts (14), so that the impact plates (4) can be detachably attached to the frame (2) by means of threaded fasteners.

Moreover, in other alternative embodiments of the central body (3), as illustrated in FIG. 3B, it is formed (and can be divided into a greater number of portions) from a first portion or ring (16) and a second portion or core (17) couplable together, wherein the first portion (16) is configured to be coupled to the "C" transversal shaped cavity (8) of the head of the frame (2.2). The first portion (16) of the central body (3) has an essentially ring shape, wherein the attachment portion for attaching to the head cavity (2.2) is arranged in this ring, at least one poka-yoke portion remaining or not outside said cavity for the coupling of the second portion (17). This shape of the central body (3) from (and not exclusively) two parts or portions, allows for example to have a first portion (16) with one density and a second portion with another density to vary the balance of the sports racquet (1) or allows for only one of the portions of the central body (3) to be replaced if required.

In another preferred embodiment, illustrated in FIG. 3C, the second portion (17) of the central body (3) is shaped by a first part (19) and a second part (20) couplable together, wherein the first part (19) has protrusions and the second part (20) has recesses, the protrusions and recesses being arranged and positioned for the complementary tongue-and-groove insertion thereof.

In this embodiment, the impact plates (4) are each suitably attached, by means of, for example, a high-strength double-sided adhesive, such as an acrylic adhesive tape, respectively on the first part (19) and on the second part (20). In addition, the impact plates (4) are glued around the perimeter thereof by means of a high-strength double-sided adhesive, such as an acrylic adhesive tape, a shock-absorbing gasket, such as neoprene, which will function as a separator between the flange (9) (head portion of the frame) and the attachment portion of the impact plate (4).

In this way there is a detachable racquet (7), since, with the first portion (16) of the central body (3) coupled to the cavity of the head portion (2.2), the first part (19) and the second part (20) are coupled together so that the impact plates (4) each rest on the flanges (9) (attachment portion) of the head portion (2.2) of the frame (2), being able to be attached to the latter by means of releasable joinings, such as a threaded fastener or screw (15*a*). Alternatively, the shock-absorbing gasket (21*a*) can be anchored to the flanges (9) of the frame (2) to fulfil the same function.

As seen in FIGS. 10-13, all possible configurations of the racquet (1) are compatible with a series of common accessories such as: a grip (35), a protector (34) of the head of the frame (2.2), a strap (29) and a plug with housing (36) for a counterweight (37) or an electronic system (25).

Alternatively, the strap (29) can be presented as a single component or divided into two portions (not exclusively). A first portion (29*a*) coupled to the handle portion (2.1) and a second portion (29*b*) corresponding to the portion that is attached to the wrist of the player. The joining game between both portions is possible through a coupler (29*c*).

Figure 14:
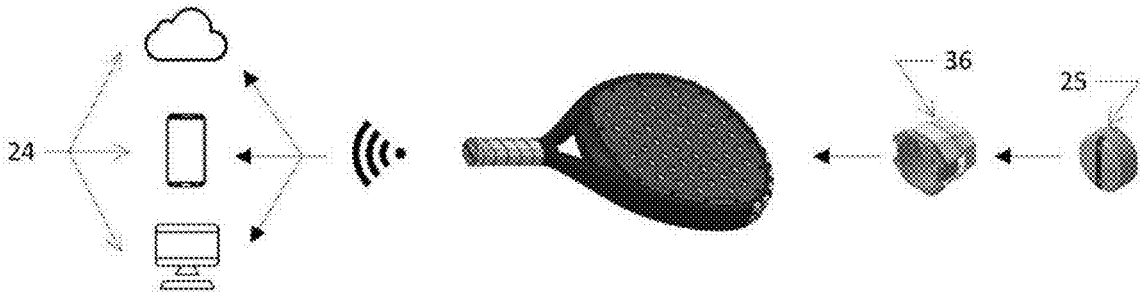
FIG. 14 is a schematic view of the electronic system of the racquet present in any of the modalities thereof.

As can be seen in FIG. 14, the racquet (1), in any of its modalities, includes detection means (not illustrated) arranged in the frame (2) and/or in the central body (3) and/or in the impact plate (4), configured to record data on the use of the sports racquet (1), and also configured to transmit said data to an external terminal (24). In particular, such detection means can be arranged in a recess in the handle portion (2.2), which can take the form of an electronic system (25) including, for example, battery, wireless transmitter and receiver, gyroscopes, accelerometers or the like to record and transmit vibrations, accelerations, orientation of the paddle, etc., in order to provide data that can be used by the user to analyze their way of playing and improve their performance, wherein such data can be transmitted to an external terminal for the subsequent processing thereof.

It is important to note that, although the frame (2) can be made such that the head portion (2.2) and the handle portion (2.1) can be coupled together, in the preferred embodiment, the frame (2) is monocoque or single piece, such that the head portion (2.2) and the handle portion (2.1) are formed in the same body. The fact that the frame (2) is a single piece is advantageous in terms of the stability of the racquet (1) and the durability thereof, as well as to facilitate the coupling of the central body (3) and the impact plates (4).

The materials from which the frame (2) or the impact plates (4) are made cover a wide range of thermosetting and/or thermoplastic matrices reinforced with reinforcing fibers of glass, carbon, aramid, Kevlar, among others, or combinations of the same (23). Likewise, the central body (3) can be made of a suitable foamed cross-linked polymeric material, for example, foam rubber, with different densities depending on the customization or the functionalities that are to be given to the sports racquet (1).

Figure 8:
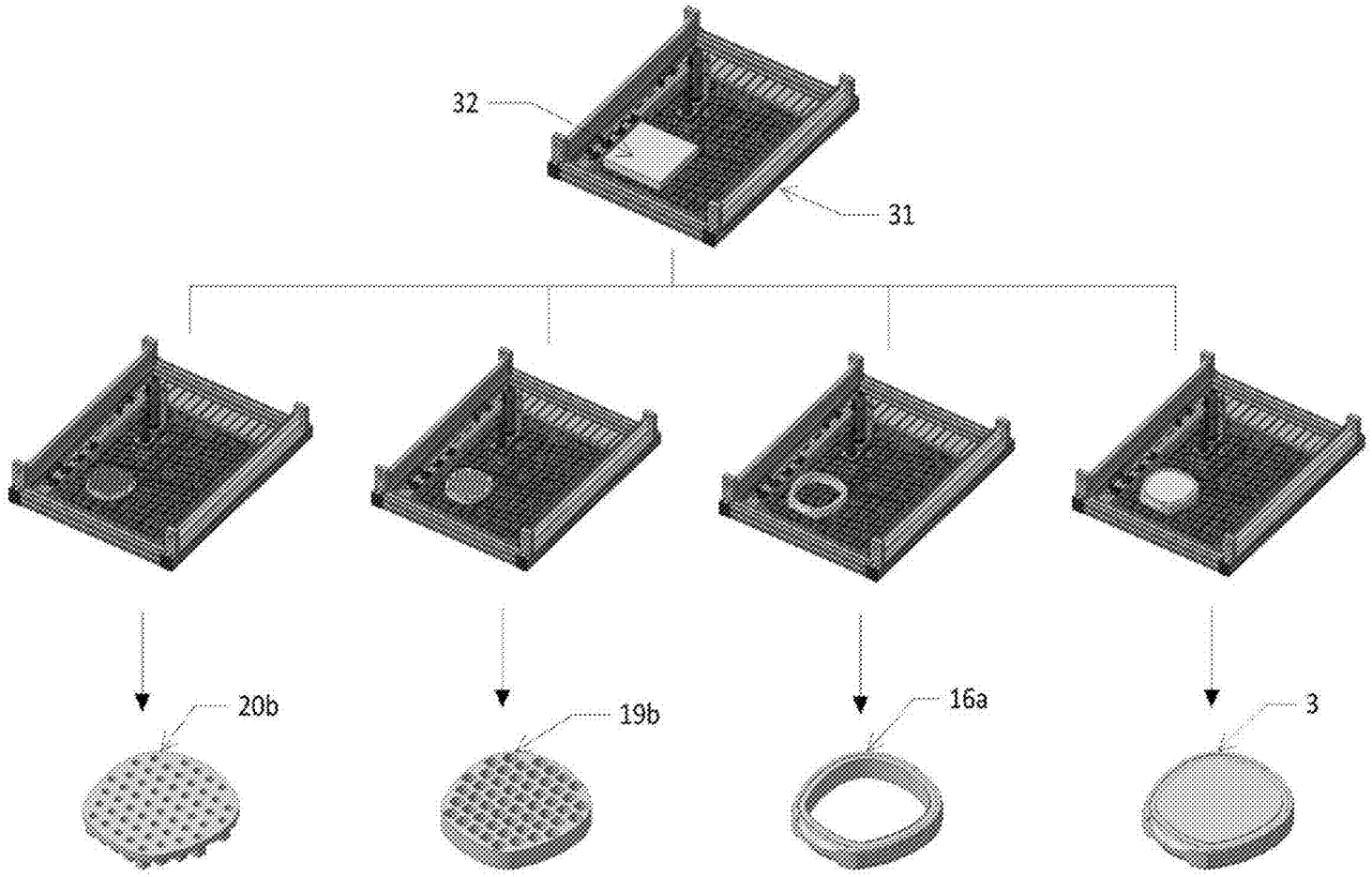
FIG. 8 is a schematic view of the method for manufacturing the central body.
Figure 9:
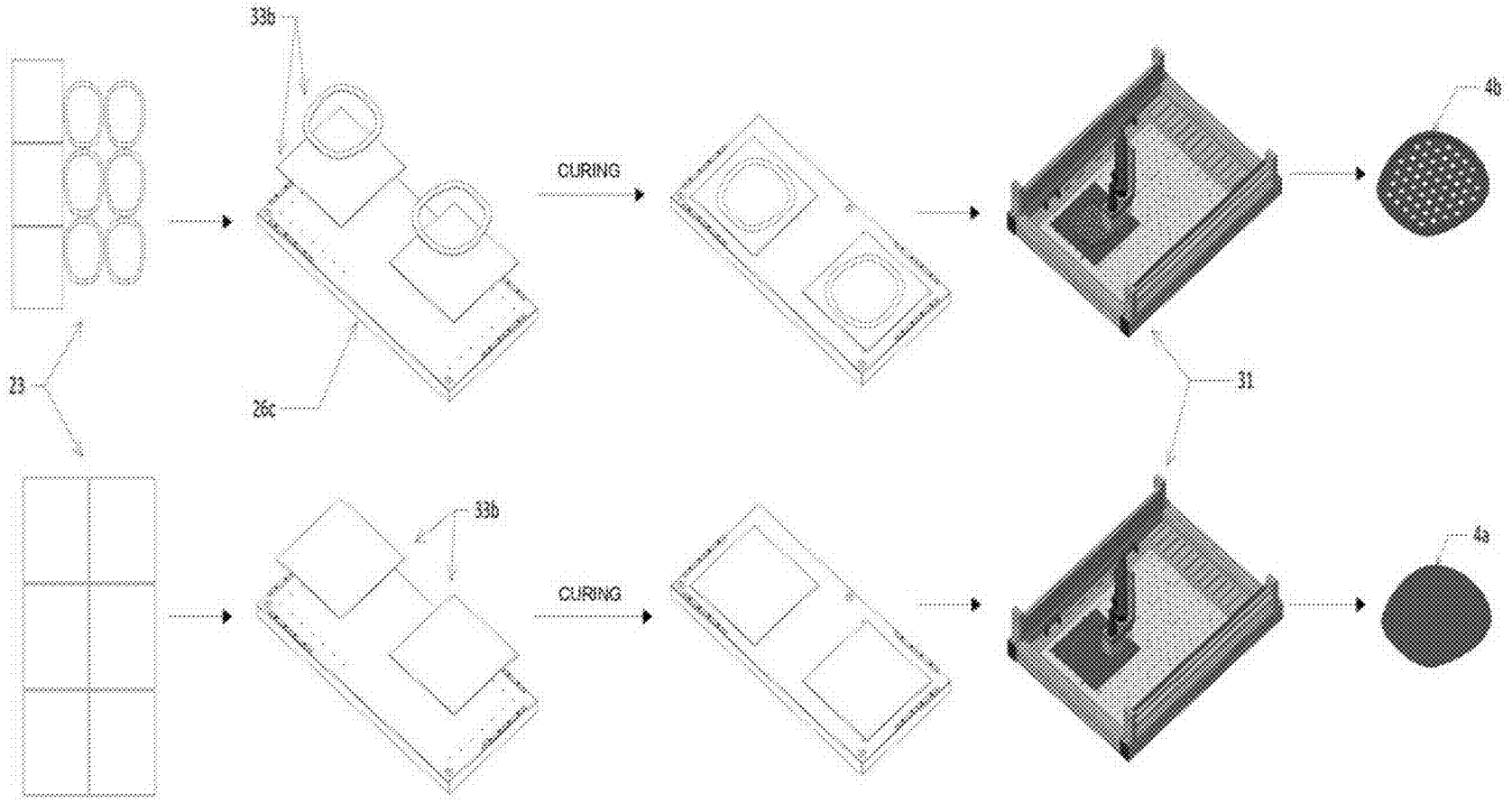
FIG. 9 is a schematic view of the method for manufacturing the impact plates.

In addition to the above, and as shown in FIGS. 8 and 9, the invention provides a method for manufacturing the central body (3) and the impact plates (4) of the sports racquet (1) as described until now, wherein, due to the nature of said racquet (1), which is assembled from three independent elements, it includes a step of providing a frame (2), a step of manufacturing a central body (3) and a step of manufacturing impact plates (4).

The manufacture of the frame (2) is previously carried out under methods for handling and shaping structures that are based on composite materials, for example, carbon fiber, glass, Kevlar, among others, which enable a monocoque frame to be obtained wherein the handle (2.1) and the head portion (2.2) can be coupled together, or the frame (2) is a single piece with handle (2.1) and head portion permanently attached. Additionally, depending on the type of racquet, once the frame is provided, it is machined for final shaping. The machining can be carried out on a CNC machine (31) that enables the final shaping of the frame (2) according to the type of racquet (1) to be assembled, i.e., depending on whether it is detachable, permanent or semi-permanent. An auxiliary referencing and positioning attachment system can be used as a support.

In addition, when the racquet (1) has a detachable arrangement, when machining the frame (2) for final shaping, holes are further machined that enable the direct coupling of the self-locking threaded inserts (14) or star-shaped inserts (13) in which the previous self-locking threaded inserts (14) are housed; thus obtaining the frame (2*b*), detachable racquet (7).

Alternatively, the star-shaped inserts (13) can be offered in different geometric configurations, as long as their design preserves the anti-rotation functionality thereof.

Moreover, the step of manufacturing the central body (3), as seen in FIG. 8, includes machining a block (32) of polymeric material by means of a CNC machine. Alternatively, the manufacture of the central body (3) is carried out by means of an injection process of polymeric materials.

In the embodiment of the racquet with permanent attachment (5) or semi-permanent attachment (6), this manufacturing step results in a central body (3) made up of a single piece of polymeric material, as shown in FIG. 3A.

Alternatively, in the manufacture of the central body (3), the same is divided into two or three components:

A first ring-shaped part (16); and

A second part (17) couplable to the first part.

At the same time, the second part (17) is divided into two parts couplable together, in the form of:

A first impact portion (19); and

A second impact portion (20).

Moreover, as seen in FIG. 9, the step of manufacturing the impact plates (4) includes:

providing a composite material (carbon fibers, glass, Kevlar or any combination, or similar materials) in prepreg format, wherein this prepreg material (23) (in sheet or fabric format) is formed according to patterns or shapes and orientations (e.g., 90° or 45°) obtaining patterned sheets;

depositing at least one layer of patterned sheet (33*b*) making an impact plate preform of a preset thickness in a mold (26*c*);

performing a curing cycle, heating the mold (26*c*) with the impact plate preform to a preset curing temperature and applying a preset curing vacuum pressure, monitoring and controlling the start, hold and end of the curing temperature and curing vacuum pressure;

demolding the shaped impact plate (4) from the mold (26*c*); and machining (with a CNC machine (31)) the impact plate (4) for final shaping.

Alternatively, in the method for manufacturing a racquet with detachable joining (7), in the manufacture of the impact plates (4), a patterned sheet is further deposited forming an outer ring to provide an added thickness suitable for drilling holes. Likewise, during the machining, a countersinking or counterboring of said holes is carried out; which allows the fastener (15) to be positioned flush with the impact plate (4) itself. The machining of the collection of central holes will also be carried out, resulting in the impact plate (4*b*), as illustrated at the end of the schematic method in FIG. 9.

In the method of manufacturing a racquet with permanent attachment (5) or a racquet with semi-permanent attachment (6), in the manufacture of the impact plates (4); machining with a CNC machine (31) will be carried out to either finish profiling the outer perimeter of the impact plate, or to obtain the shape if, for example, the cured plate does not have a shape essentially identical to the one that is expected to be obtained from the impact plate (4).

However, after the manufacture of the frame (2), the manufacture of the central body (3) and the manufacture of the impact plates (4), the final assembly of the different parts is carried out depending on the functionality of the target racquet.

Figure 11:
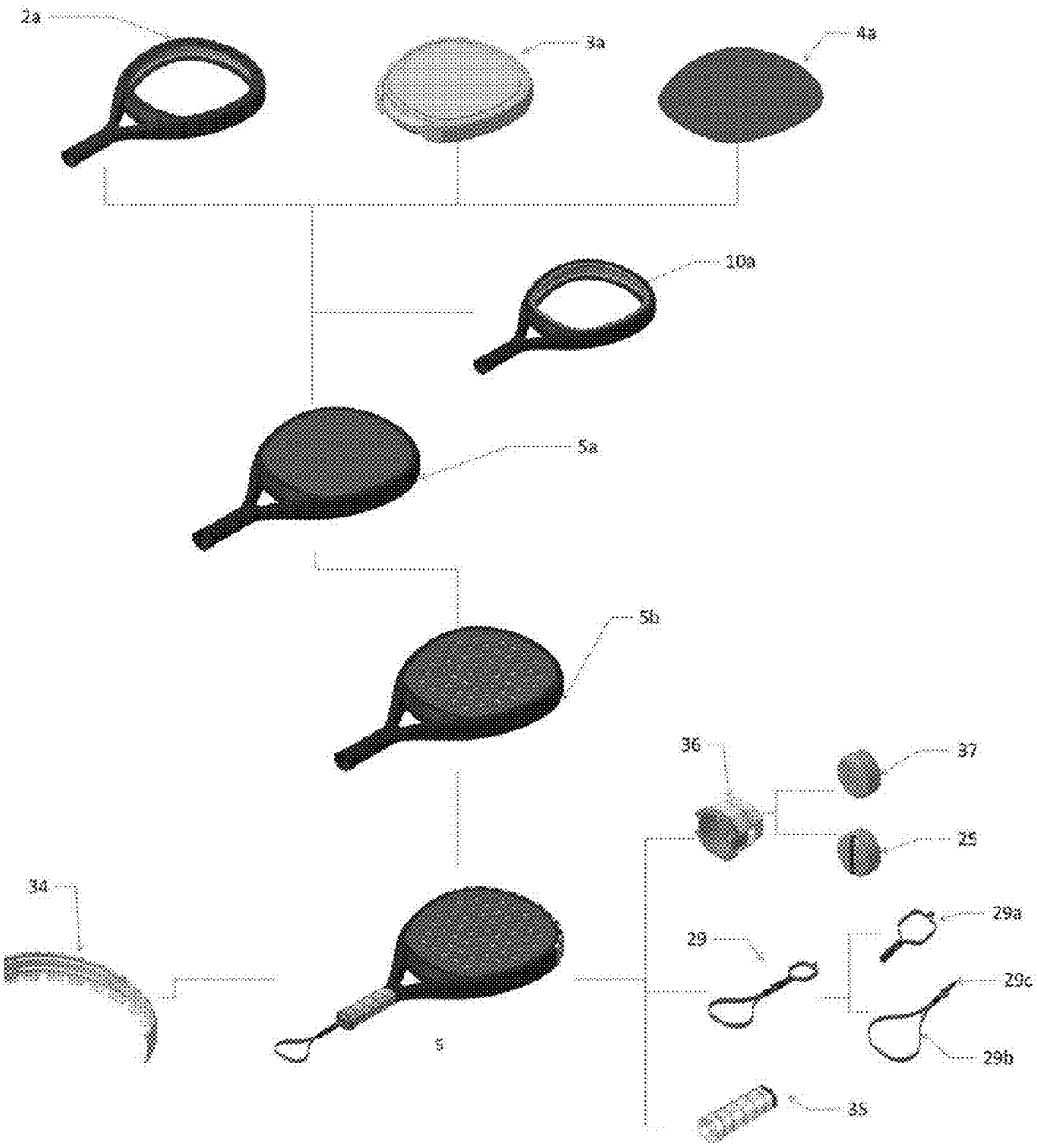
FIG. 11 is a schematic view of the method for assembling the sports racquet in the permanent modality thereof.

Therefore, for the manufacture and, especially, the assembly of a racquet with permanent joining (5), as illustrated in FIG. 11, the central body (3) is incorporated into the frame (2*a*) without drilling (3*a*) formed by a single piece, on which the unperforated impact plates (4*a*) are positioned with adhesive means. These, in turn, are solidly joined to the frame (2*a*) by means of a structural adhesive means, such as epoxy (10*a*) or similar features. Next, the unperforated racquet with permanent joining (5*a*) is ready for machining, for example, on a CNC machine, wherein the corresponding central holes of the impact plate(s) (4) and of the central body (3) will be machined.

Figure 12:
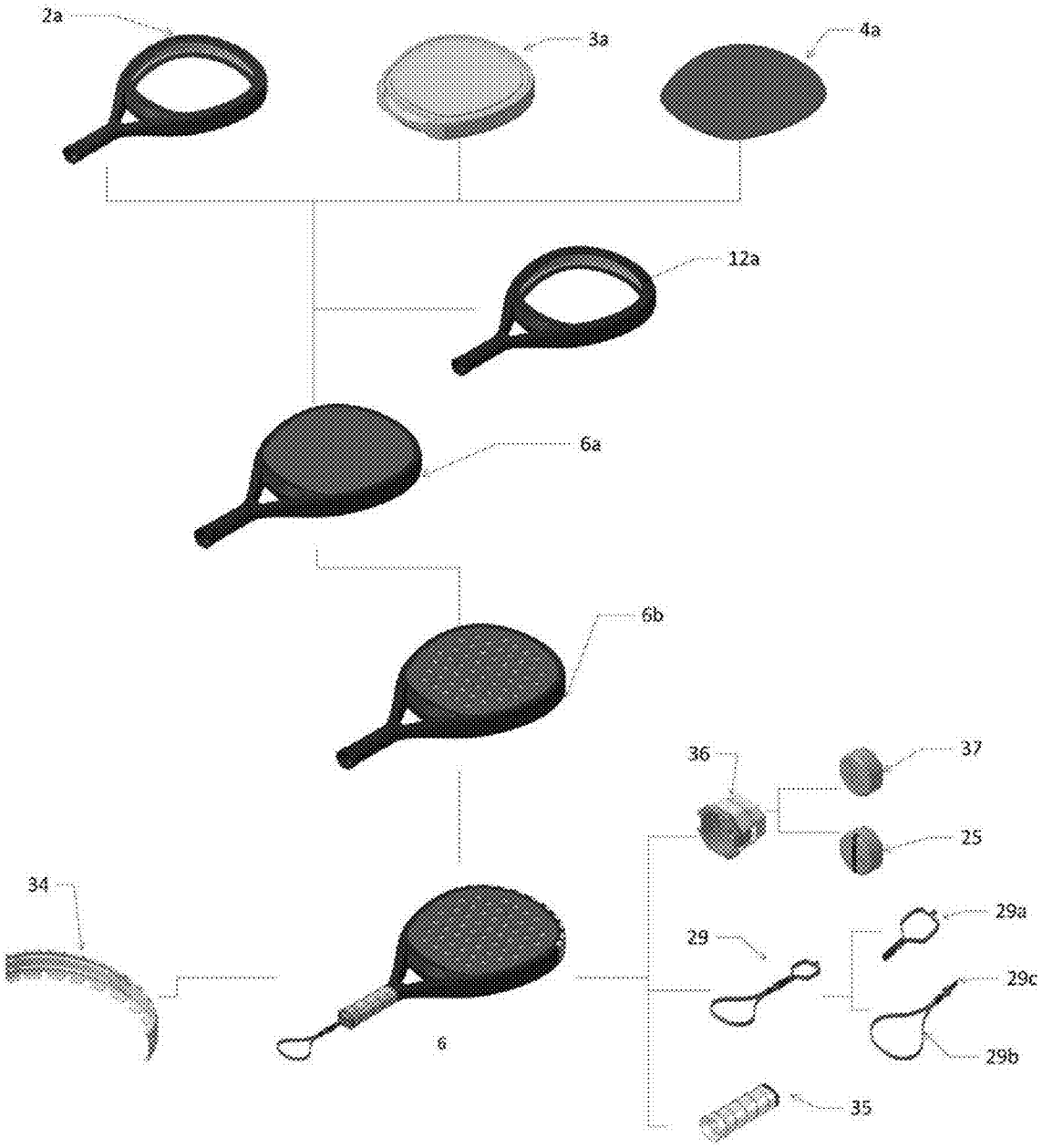
FIG. 12 is a schematic view of the method for assembling the sports racquet in the semi-permanent modality thereof.

Furthermore, as can be seen in FIG. 12, for the manufacture and assembly of a racquet with permanent joining (6), the unperforated central body (3*a*), formed by a single piece, is incorporated into the frame (2*a*), on which the unperforated impact plates (4*a*) are adhesively positioned. These, in turn, are solidly joined to the frame (2*a*) by means of a double-sided acrylic foam adhesive tape (12*a*) or with similar features. Next, the unperforated sports racquet with semi-permanent joining (6*a*) is arranged for machining, for example, on a CNC machine, wherein the corresponding central holes of the impact plate(s) (4) and of the central body (3) will be machined.

Figure 10:
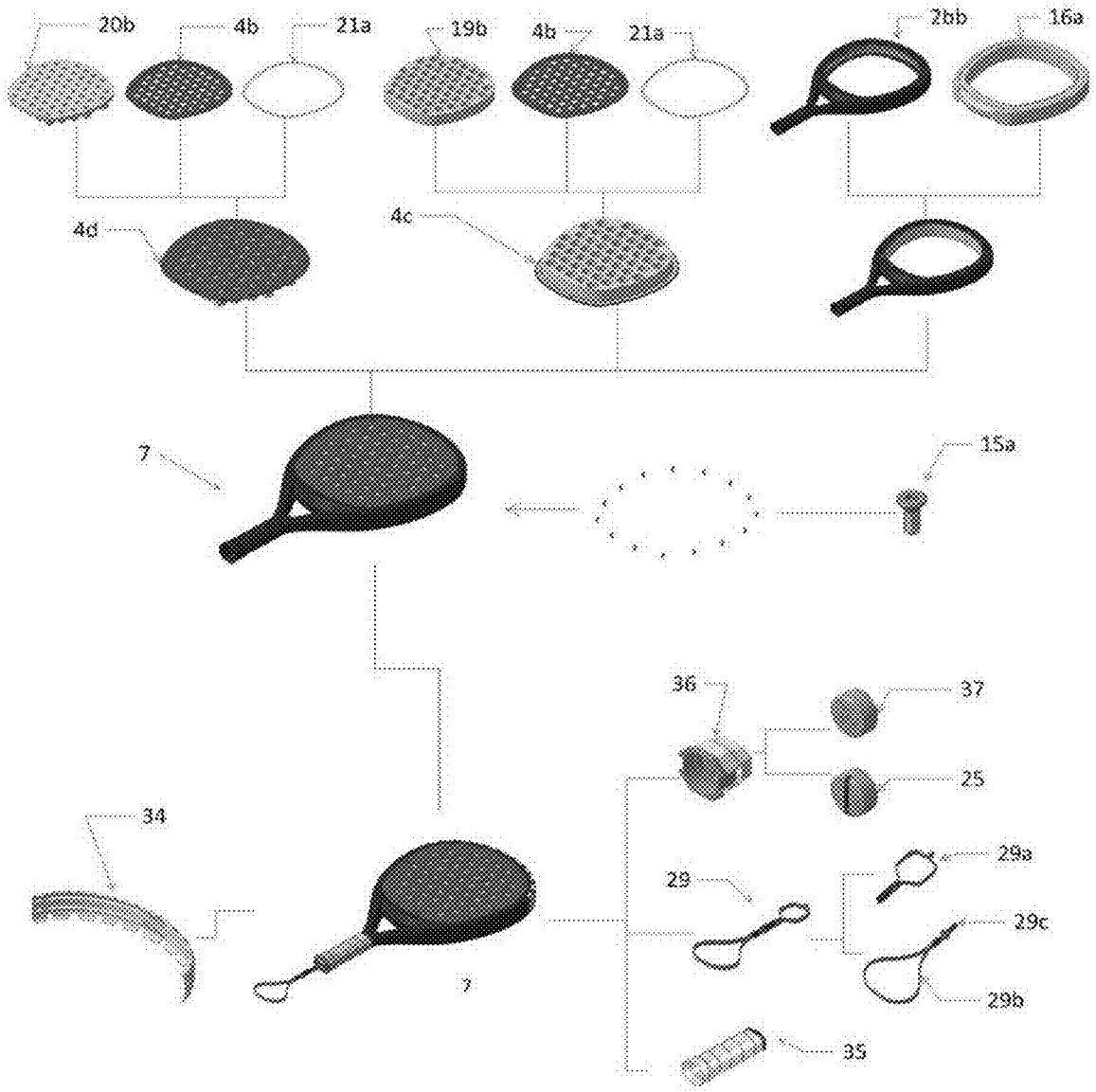
FIG. 10 is a schematic view of the method for assembling the sports racquet in the detachable modality thereof.

Now, for manufacturing and assembling a detachable racquet (7), illustrated in FIG. 10, a certain number of previously described insert assemblies are incorporated into the frame (2*b*), which will enable the coupling of threaded fasteners (15*a*). Subsequently to the frame (2*bb*), of FIG. 5A, the first portion (16) of the central body (3) in the shape of a ring is incorporated therein. In parallel, each of the portions (18) (19) of the second portion (17) of the central body (3) are assembled to the respective impact plates (4). The first portion (19) and the second portion (20) are permanently attached to the respective perforated impact plates (4) thereof and with a reinforcement ring (4*b*), FIG. 5C, the shock-absorbing tape or gasket (21*a*) is further incorporated. The impact plates (4*b*) with gasket and first portion (19) and second portion (20) can then be joined to the frame (2*bb*) by means of the threaded fasteners (15*a*) giving rise to the paddle with detachable joining (7).

Figure 13:
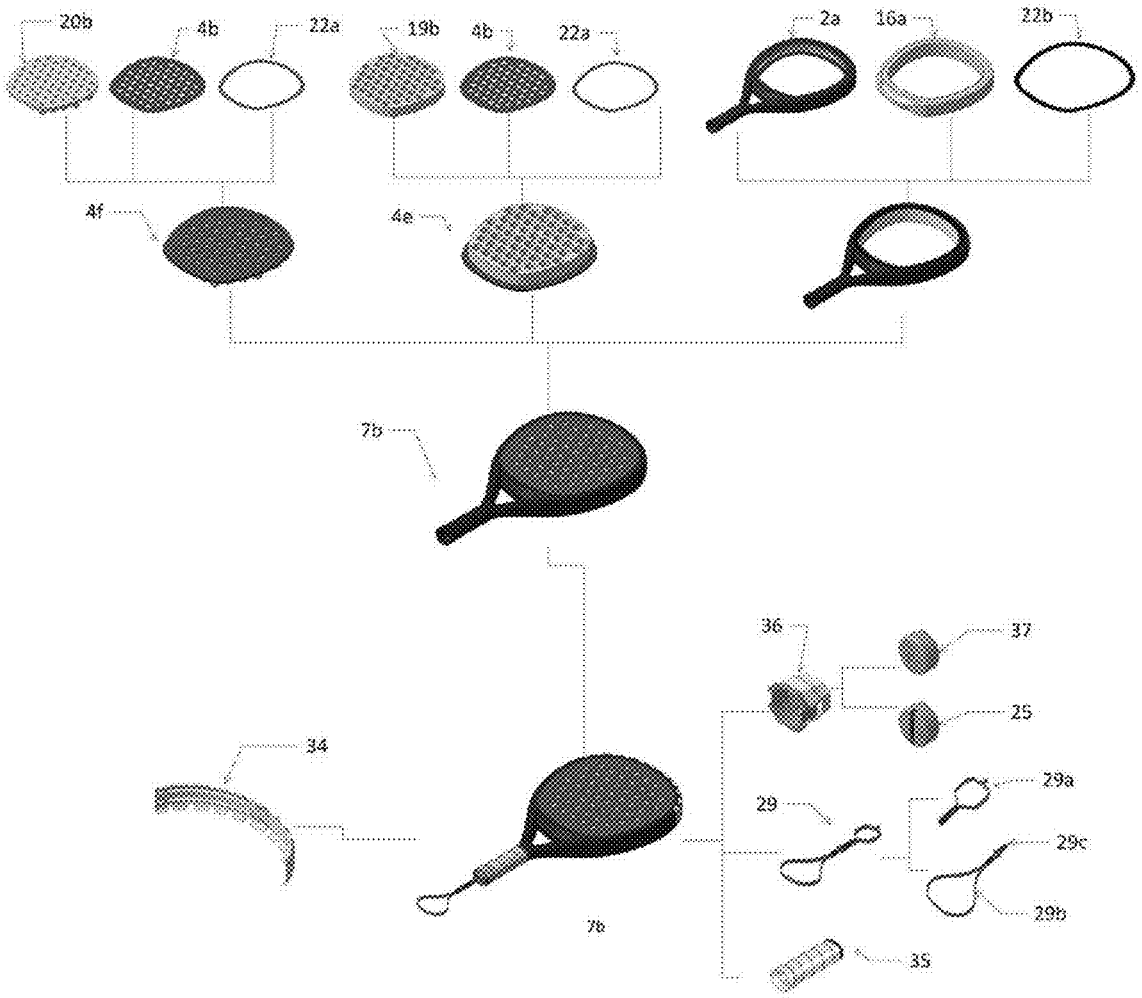
FIG. 13 is a schematic view of the method for assembling the sports racquet in an alternative detachable modality.

Alternatively, for the manufacture and assembly of a racquet (7*b*) with detachable joining and hook and loop mechanism, as illustrated in FIG. 13, the final racquet assembly process is analogous to that described above with two exceptions: The shock-absorbing gasket (21*a*) is replaced by portion one of the hook and loop fastener (22*a*); and the frame (2*a*) that is devoid of insert assemblies receives portion two of the hook and loop fastener (22*b*) on the flange (9).

Due to the present invention, a racquet (1) optimized in terms of weight and functionalities is achieved, allowing the consumer to choose and/or personalize it, adapting it to their tastes and style of play, as well as the possibility of maintaining and updating it. Currently there is no racquet on the market that offers the possibility of replacing broken, worn or obsolete components.

Due to the demands in weight, stiffness, wear, resistance to impact and corrosion, composite materials are the ideal material for manufacturing the racquet of the invention in any of the modalities thereof. The frame (2) is the main structure the innovative design of which enables it to be laminated in an easily accessible open mold, wherein the combination and positioning of different reinforcement materials are possible.

The cavity (8) seen in a "C"-shaped cross section (8) of the head portion (2.2) and the attachment region (9) in the form of flanges that act as an interface with the impact plate (4), are the differentiating design features of the sports racquet (1) of the invention.

What is claimed is:

1. A sports racquet, comprising:

a frame provided with a head portion and a handle portion, wherein the head portion has an arcuate shape wherein a cavity is disposed along the head portion;

a central body couplable to the cavity of the head portion; and an impact plate couplable to an attachment region arranged in the head portion and/or couplable to the central body, wherein attachment means are arranged in the attachment region and configured for coupling the impact plate;

wherein the central body comprises a first portion and a second portion couplable together, and the first portion has a ring-like arrangement enabled for inserting thereof in the cavity of the head portion.

2. The sports racquet according to claim 1, wherein the attachment means comprise an adhesive, wherein the adhesive is at least partially arranged in the attachment region and configured to permanently join the impact plate (4) to the head portion.

3. The sports racquet according to claim 2, wherein the second portion of the central body in turn comprises a first part and a second part couplable together.

4. The sports racquet according to claim 2, wherein the cavity has an essentially "C" transversal shape, wherein the attachment region is arranged at each of open ends of the cavity of the essentially "C" transversal shape.

5. The sports racquet according to claim 1, wherein the attachment means comprise an adhesive tape, wherein the adhesive tape is at least partially arranged in the attachment region and configured to semi-permanently join the impact plate to the head portion.

6. The sports racquet according to claim 5, wherein the second portion of the central body in turn comprises a first part and a second part couplable together.

7. The sports racquet according to claim 1, wherein the attachment means comprise a releasable connection system, wherein the releasable connection system is at least partially arranged in the attachment region and configured to releasably join the impact plate to the head portion.

8. The sports racquet according to claim 7, wherein the releasable connection system comprises a plurality of inserts spacedly attached to the attachment region, and each of the plurality of inserts is configured for the respective coupling of a fastener, such that the impact plate is configured to be coupled to the attachment region through combination of the plurality of inserts and fasteners.

9. The sports racquet according to claim 8, wherein the second portion of the central body in turn comprises a first part and a second part couplable together.

10. The sports racquet according to claim 7, wherein the second portion of the central body in turn comprises a first part and a second part couplable together.

11. The sports racquet according to claim 1, wherein the second portion of the central body in turn comprises a first part and a second part couplable together.

12. The sports racquet according to claim 11, wherein the impact plate comprises a first impact plate and a second impact plate, wherein the first impact plate is enabled to be coupled to the first part, and the second impact plate is enabled to be coupled to the second part.

13. The sports racquet according to claim 1, wherein the cavity has an essentially "C" transversal shape, wherein the attachment region is arranged at each of open ends of the cavity of the essentially "C" transversal shape.

14. The sports racquet according to claim 1, wherein the cavity has two flanges respectively arranged in the open ends, wherein the attachment region is disposed in each of the two flanges.

15. The sports racquet according to claim 1, wherein the frame is a one-piece monocoque structure, wherein the head portion and the handle portion are permanently coupled in the one-piece monocoque structure.

16. The sports racquet according to claim 1, further comprising detection means arranged in the frame and/or in the central body, wherein the detection means are configured to record data on use of the sports racquet and transmit the data to an external terminal.

17. A method for manufacturing and assembling the sports racquet according to claim 1, comprising steps of:

providing the frame;

manufacturing the central body, wherein the step of manufacturing the central body comprises steps of machining a block of polymeric material;

manufacturing the impact plate; and assembling the central body and two impact plates on the frame;

wherein in the step of machining the block of polymeric material to form the central body, the central body is divided into two portions by machining:

a first ring-shaped portion intended to be inserted into the cavity of the frame-; and a second portion couplable to the first portion.

18. The method according to claim 17, wherein the step of manufacturing the impact plate comprises steps of:

depositing layers of patterned fabric made of composite material making an impact plate preform of a preset thickness in a mold;

heating the mold to a preset curing temperature and applying a preset curing vacuum pressure, monitoring and controlling start, hold and end of a curing temperature and a curing vacuum pressure;

demolding a shaped impact plate from a tool; and machining the impact plate for final shaping.

19. The method according to claim 17, wherein the step of depositing the layers of patterned fabric made of composite material making the impact plate preform of the preset thickness in a mold comprises depositing the layers of patterned fabric made of composite material to form a ring on a periphery of the impact plate preform, this ring being thicker than a predetermined thickness of the impact plate preform.

20. The method according to claim 17, wherein in the step of machining the block of polymeric material to form the central body, the second portion is divided into two parts couplable together in a form of a first part and a second part, wherein the first part and the second part are allowed to be coupled to the first portion.

* * * * *